US005180322A

United States Patent [19]

Yamamoto et al.

[11] Patent Number: 5,180,322

[45] Date of Patent: Jan. 19, 1993

[54] MANUFACTURING PROCESS OF SHADOW MASK AND SHADOW MASK PLATE THEREFOR

[75] Inventors: Toshio Yamamoto; Koji Sawada, both of Shiga, Japan

[73] Assignee: Dainippon Screen Mfg. Co., Ltd., Japan

[21] Appl. No.: 748,458

[22] Filed: Aug. 22, 1991

[30] Foreign Application Priority Data

Aug. 22, 1990 [JP] Japan ..... 2-221964

[51] Int. Cl.[5] ..... H01J 9/14; H01J 29/06

[52] U.S. Cl. ..... 445/37; 445/47; 313/402; 72/363

[58] Field of Search ..... 445/36, 37, 47; 313/402; 72/363

[56] References Cited

U.S. PATENT DOCUMENTS

| | | | |
|---|---|---|---|
| 4,427,396 | 1/1984 | Van Den Berg | 445/47 |
| 4,478,589 | 10/1984 | Takenaka et al. | 445/37 |
| 4,482,334 | 11/1984 | Ohtake et al. | 445/37 |

FOREIGN PATENT DOCUMENTS

| | | | |
|---|---|---|---|
| 0073654 | 3/1983 | European Pat. Off. . | |
| 0360868 | 4/1990 | European Pat. Off. . | |
| 49-17909 | 5/1974 | Japan . | |
| 49-79170 | 7/1974 | Japan . | |
| 49-131676 | 12/1974 | Japan . | |
| 55-76082 | 6/1980 | Japan . | |
| 58-155628 | 9/1983 | Japan | 313/402 |
| 62-17937 | 1/1987 | Japan | 313/402 |
| 64-56820 | 3/1989 | Japan . | |
| 1-302639 | 12/1989 | Japan . | |
| 2-25201 | 1/1990 | Japan . | |
| 2-46628 | 2/1990 | Japan . | |
| 2-46629 | 2/1990 | Japan . | |
| 3-19243 | 2/1991 | Japan . | |
| WO89/07329 | 8/1989 | PCT Int'l Appl. . | |
| 2092920 | 8/1982 | United Kingdom . | |

OTHER PUBLICATIONS

Patent Abstracts of Japan; vol. 1, No. 47 (E-76)(2948) May 9, 1977; and JP-A-51 142 970 (Hitachi Seisakusyo K.K.) Dec. 8, 1976, *abstract*.

Patent Abstracts of Japan; vol. 9, No. 111 (M-379)(1834) May 15, 1985; and JP-A-59 232 607 (Touyou Kouhan K.K.) Dec. 27, 1984, *abstract*.

Patent Abstracts of Japan; vol. 10, No. 192 (E-147)(2248) Jul. 5, 1986 and JP-A-61 039 345 (Toshiba Corp.) Feb. 25, 1986 *abstract*.

Patent Abstracts of Japan; vol. 12, No. 139 (C-491)(2986) Apr. 27, 1988 and JP-A-62 253 783 (Nippon Mining Co., Ltd.) Nov. 5, 1987 *abstract*.

"Surface Texture Parameters with Talysurf 6".

*Primary Examiner*—Kurt C. Rowan
*Assistant Examiner*—Jeffrey T. Knapp
*Attorney, Agent, or Firm*—Ostrolenk, Faber, Gerb & Soffen

[57] ABSTRACT

A process of manufacturing a shadow mask includes the steps of preparing a plurality of metal plates having a surface deviation characterized in that its Rsk value is not more than 0.3 μm, preferably less than 0, its Sm value is not less than 60 μm, and its Pc value relative to the band of 1 μm width centered about the center line of a roughness profile is not more than 60/cm, forming a plurality of apertures in each of the plates, registrating and piling up the plates upon each other, annealing the plates piled upon each other, and pressing and molding the annealed metal plates into a predetermined curvature. Each of the metal plates preferably has Ra in the range from 0.1 to 0.7 μm.

54 Claims, 9 Drawing Sheets

MANUFACTURING PROCESS OF SHADOW MASK AND SHADOW MASK PLATE THEREFOR

BACKGROUND OF THE INVENTION

1. Field of the Invention

The present invention relates generally to a manufacturing process for producing shadow masks for use in color cathode ray tubes, etc., and more specifically, to a manufacturing process for producing shadow masks by joining a plurality of shadow mask plates stacked upon each other, and a shadow mask used in the manufacturing process.

2. Description of the Related Art

A color cathode ray tube in FIG. 1 includes an electron gun 1 for producing three electron beams B, a fluorescent material 2 arranged on a face plate for receiving the electron beams B produced by the electron gun 1 to give off three primary colors, and a shadow mask 3 arranged between the fluorescent material 2 and the electron gun 1, having a plurality of apertures formed therein for passing selectively only an electron beam in a desired direction among the electron beams B and shielding electron beams in undesired directions.

The shadow mask 3 for a color cathode ray tube is generally manufactured by a process shown in FIG. 2. Referring to FIG. 2, in the first step, a piece of low carbon aluminum killed steel or an invar alloy having a thickness between about 0.1 and 0.3 mm is prepared for a shadow mask plate. The invar alloy is, for example, an iron-nickel alloy containing 36% nickel by weight.

In the second step, a plurality of apertures are formed in the shadow mask plate by a photoetching process.

After the etching process, annealing is performed on the shadow mask plate having the plurality of apertures, for the purpose of providing the shadow mask plate with press molding applicability. The annealing is performed as follows: The shadow mask plates are lifted or piled upon each other in an oxygen-free atmosphere. The shadow mask plates formed of aluminum killed steel are heated at a temperature between about 700° C. and 900° C., while the shadow mask plate formed of an invar alloy are heated at a temperature around 1000° C. The heating of the shadow mask plate allows its yielding point, i.e. strength to be decreased, and the shadow mask plate is provided with press molding applicability. The temperature of annealing varies with the kind of material used for the shadow mask plate. In the case of the invar alloy, if the temperature of annealing is below a predetermined value, the shadow mask plate remains partially elastic. In that case, strength to return to its original shape remains in the shadow mask plate, hampering its press molding.

The annealed shadow mask is pressed into a prescribed curvature, for example into a sphere. The shadow mask is blackened in a blackening furnace for the purpose of improving its property of heat radiation and reducing the irregular refraction of electron beams, and an oxide layer is formed on the surface thereof. This process completes the manufacturing of the shadow mask.

As is well known, in a color cathode ray tube, a large number of electron beams produced by the electron gun impinge upon the shadow mask and are absorbed thereto. The energy of these absorbed beams is converted into thermal energy on the shadow mask whereby the latter is heated. The shadow mask is thermally expanded, resulting in thermal deformation called "doming". The term doming indicates a phenomenon in which the shadow mask is expanded to the side of a fluorescent material.

In doming, the positions of the apertures on the shadow mask are naturally out of their normal positions. The passing electron beam is out of its normal trajectory, reaching a fluorescent material which is not the target of the beam. As a result, the color of a color picture is not given off correctly. This result comes about especially in the case of a large sized CRT wherein the above-described doming results in greater deformation, thereby, degrading the resultant picture quality.

The degradation in images as described above should be prevented. The most general approach for solving this problem is thickening the shadow mask plate. The strength of the shadow mask is also increased by this process. The deformation of the shadow mask is thus less likely to happen, reducing the possibility that the electron beam passes out of its normal trajectory.

The thickening of the shadow mask plate, however, gives rise to another problem. The problem is associated with the etching process for forming apertures on the shadow mask plate. In the etching process, side etching is inevitable. A hole is expanded in the direction vertical to the direction of the thickness of the shadow mask plate. As the thickness of the shadow mask plate increases, a longer time period will be required for forming the apertures by etching. This allows the expansion of the hole in a transverse direction due to the side etching to be even larger. If the spacing between apertures is small increasing mask plate thickness increases the probability that adjacent apertures will be connected to each other due to the side etching. With large-sized color cathode ray tubes being more prevalent in the market, there has arisen a demand for color CRTs with higher resolution. To meet the demand, it is necessary to reduce the spacing of apertures in the shadow mask. If a thick shadow mask plate is used, the recent demand as stated above cannot be met.

A manufacturing method of a shadow mask avoiding the above-described problem and satisfying the recent demand is disclosed, for example, in Japanese Patent Laying-Open No. 49-79170, No. 49-131676, World Patent Laying-Open (National Publication of a Translated Version of International Application) No. WO89/07329, and Japanese Patent Laying-Open No. 1-302639. Referring to FIG. 3, by this method, two shadow mask plates 4 and 5 each having a plurality of apertures 6 and 7 previously formed by means of photoetching are prepared. The shadow mask plates 4 and 5 are piled or staked upon each other so that the apertures 6 and 7 are registered to each other, and shadow mask plates 4 and 5 are joined to each other to produce a shadow mask.

In the above-described methods, a plurality of shadow mask plates should be joined entirely with each other. This is because sufficient strength is particularly needed for a large-sized shadow mask. Otherwise the central portion of the shadow mask will be dented by a shock given to the shadow mask in the manufacturing process of a color cathode ray tube. Further, a large stress is given to the shadow mask in the process of press-molding and, therefore, the apertures on one plate are liable to be displaced from the apertures on the other plate.

A method of joining a plurality of shadow mask plates with each other is disclosed in Japanese Patent Laying-Open Nos. 2-46628, 2-46629, etc. Proposed therein is spot-welding the entire surfaces of the shadow mask plates piled upon each other at several cm intervals, using a laser beam or an electron beam. However, such a method, is accompanied by problems that have yet to be solved for example, assume that shadow mask plates each having a diagonal distance of for example 20 inches are spot-welded at 3 cm intervals. In this case, the shadow mask plates are welded and joined to each other at more than 150 points. The welding for each point itself is completed in a short period of time. Registration for the welding, however, should be carried out precisely. The time required for such registration is supposed to be about 15 seconds for each position. It therefore takes more than 30 minutes to produce one shadow mask by welding two shadow mask plates. Thus, it is seen that the manufacturing process for producing the shadow mask becomes very inefficient so that it is difficult to justify practicing such a process for industrial purposes.

SUMMARY OF THE INVENTION

It is therefore an object of the present invention to provide a process of manufacturing a shadow mask by which a plurality of shadow mask plates can be joined to each other efficiently and to provide a shadow mask plate therefor.

Another object of the present invention is to provide a process of manufacturing a shadow mask by which a plurality of shadow mask plates can readily be joined to each other and to provide the shadow mask plate therefor.

Yet another object of the present invention is to reduce time required for a process of manufacturing one shadow mask by joining a plurality of shadow mask plates to each other and to provide a shadow mask plate permitting such a reduction.

The present invention defines a process of manufacturing a shadow mask suitable for use in a cathode ray tube and includes the steps of preparing a plurality of metal plates, forming a plurality of apertures for allowing electron beams to pass therethrough; stacking or piling up the plurality of metal plates closely into contact and positioned so that the apertures formed on each of the metal plates are arranged in a predetermined positional relation; annealing the metal plates piled upon each other; and pressing the piled and annealed metal plates into a prescribed curve. Preferably, each of the metal plates has a surface deviation characterized in that its Rsk value (which will be described later in detail together with other parameters) is not more than 0.3 μm, preferably less than 0, its Sm value is not less than 60 μm, and its Pc value relative to the band of 1 μm width centered about the central line is not more than 60/cm. With each of the metal plates having such surface deviation that its Rsk value is not more than 0.3 μm, preferably less than 0, the protruding portions formed on the surface of the metal plate have trapezoidal shapes with a relatively large area in the vicinity of its peak. The area of contact between the piled up metal plates is larger compared to the case in which the Rsk value is larger. The metal plates in close contact are therefore joined firmly to each other in the subsequent annealing process. Furthermore, the average distance between the peaks formed on the surface of each metal plate is not less than 60 μm and, therefore, the surfaces of the metal plates are easily joined to each other. With the peak count value Pc being small, the adherence of plate materials to each other is not hampered, so that the adherence of the metal plates to each other in the subsequent annealing process will be good.

In another aspect of the present invention, each of the metal plates have a surface deviation the Ra value (which will be described later in detail together with other parameters) that falls in the range between 0.1 μm and 0.7 μm. If the Ra value is less than 0.1 μm, resist will not adhere well to the surface of the metal. Further, in the process of exposure, a longer period of time is required for vacuum-contacting a master pattern onto the surface of the metal plate. Also, if the Ra value is more than 0.7 μm, etching is not performed successfully, resulting in the loss of linearity at the edge of the apertures. The amount of electron beam passing through the manufactured shadow mask varies depending on the position of the apertures, resulting in degradation in the quality of the shadow mask. If the Ra is in the range between 0.1 μm and 0.7 μm, as in the present invention, etching is performed successfully, and, therefore, the quality of the shadow mask is maintained.

A shadow mask obtained by the process of the present invention can therefore maintain high performance of a cathode ray tube and can be produced using a plurality of metal plates without providing a separate process step of joining these plates.

In another aspect of the present invention, a shadow mask plate for manufacturing a shadow mask includes a metal plate having a surface deviation characterized in that its Rsk value is not more than 0.3 μm, its Sm value is not less than 60 μm, and its Pc value relative to the band of 1 μm width centered about the center line is not more than 60/cm. The Rsk value of the surface deviation of the metal plate is preferably negative.

The preparation of metal plates having a surface deviation as described above for shadow mask plates permits apertures to be formed successfully by etching.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

According to the present invention, each of the parameters indicative of the surface deviation of a metal shadow mask plate is significant so that each parameter will be defined prior to the description of embodiments. Throughout this specification and appended claims, each of these surface deviations indicating parameters is used based on the following definitions. There are four major parameters Ra, Rsk, Sm and Pc to be defined.

Ra, the most commonly used international parameter defining roughness in a surface, is the arithmetic mean value of all the points on a roughness profile within an evaluation length L. When the center line of the roughness profile within the evaluation length L is read along X- axis, a distance y from the center line is read along Y-axis, and the roughness profile is represented by y=Y (x), Ra is obtained by the following equation:

$$Ra = \frac{1}{L}\int_{O}^{L} |Y(x)|dx$$

Rsk is referred to as "skewness", a value indicative of the symmetry between the upper and lower halves of the roughness profile relative to the mean line of roughness within the evaluation length L. Rsk is represented by the following equation:

$$Rsk = \frac{1}{nRq^3}\sum_{i=1}^{n}(y_i)^3$$

where n represents the number of data points on the roughness profile, $y_i$ is the value of ordinate at the i-th data point, and Rq is a parameter called mean square roughness. Rq is the time (root means square) of the departures of the roughness profile from the mean roughness in the evaluation length L, and is found by the following equation:

$$Rq = \sqrt{\frac{1}{L}\int_{O}^{L} Y^2(x)dx}$$

Figure 1:
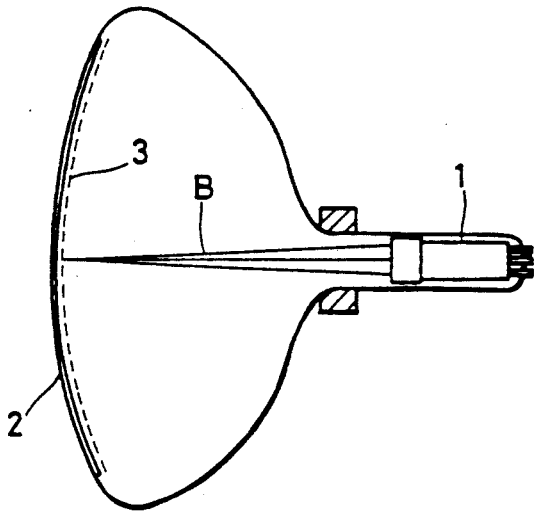
FIG. 1 is a sectional view schematically showing a color cathode ray tube.
Figure 2:
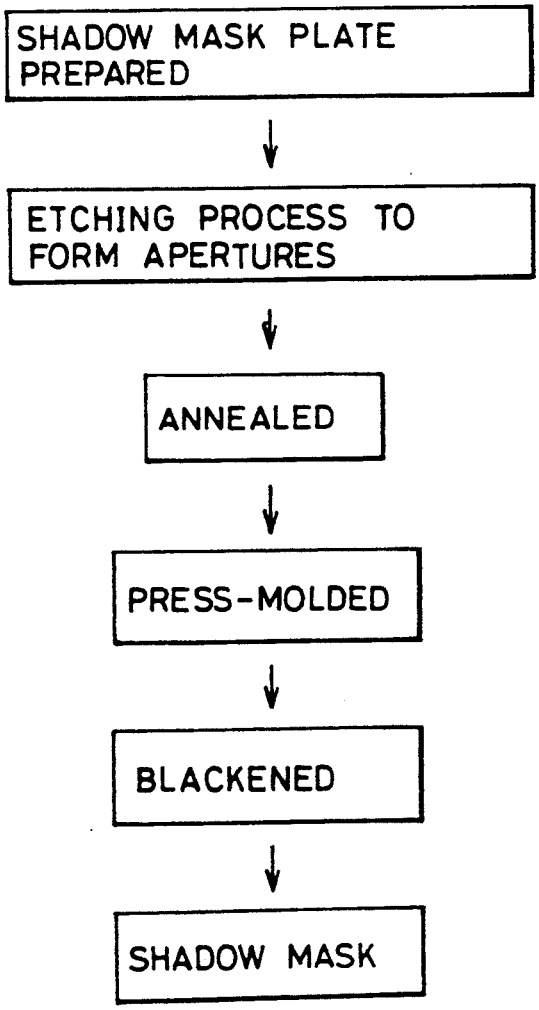
FIG. 2 is a diagram schematically showing a general manufacturing process of a shadow mask.
Figure 3:
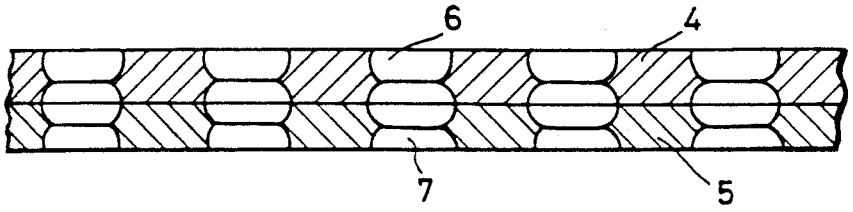
FIG. 3 is a sectional view schematically showing a part of a shadow mask including two shadow mask plates.
Figure 4:
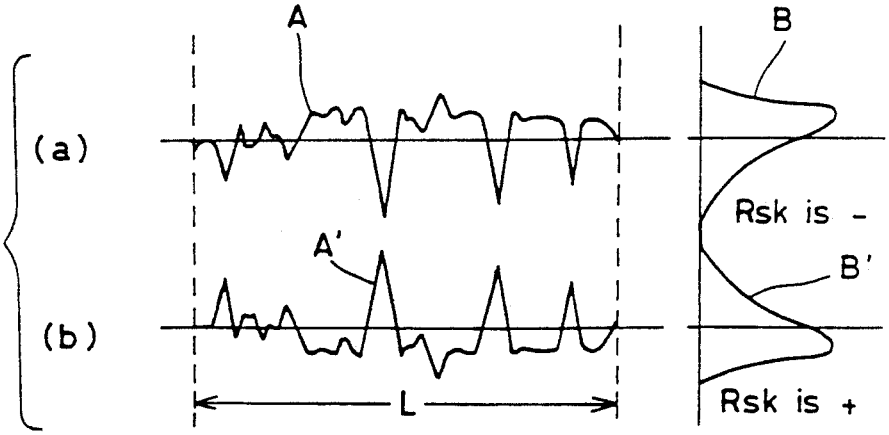
FIG. 4*a* and FIG. 4*b* are diagrams schematically showing a roughness profile and amplification distribution curve for illustrating a skewness Rsk.

The characteristics of the surface deviation represented by Rsk is as in the following. For example, two roughness profiles A and A' shown in FIGS. 4(*a*) and (*b*) are equal in Ra. Even in that case, although the maximum value of the amplification distribution curve B is above the mean line when Rsk is a negative value as shown in FIG. 4(*a*), the maximum value of the amplification distribution curve B' of the roughness curve A' is below the mean value of the roughness as shown in FIG. 4(*b*) when Rsk is a positive value. In the former case, a mountain-like shapes on the curve as shown along the roughness profile A in FIG. 4(*a*) are of the trapezoid-like shapes having a large area in the vicinity of its peak. In the latter case, the mountain-like shapes on the roughness curve as represented by the roughness profile A' in FIG. 4 (b) become sharp.

Sm represents the mean spacing between two profile peaks adjacent to each other at the mean line measured over the evaluation length L. A profile peak is the highest point of the profile between an upward and downward crossing of the mean line.

Figure 5:
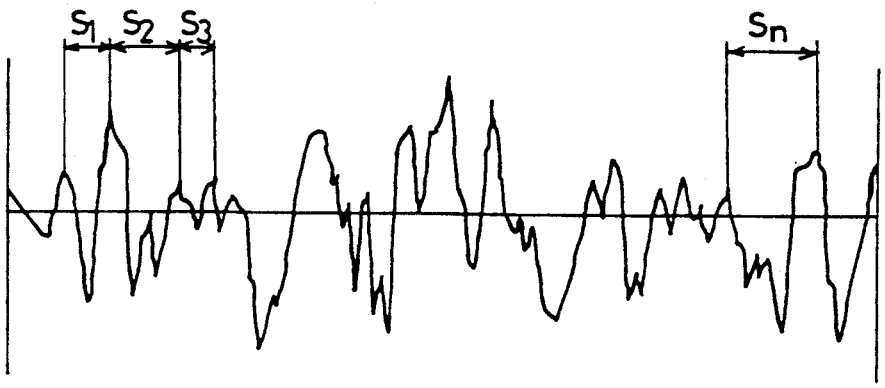
FIG. 5 is a diagram schematically showing a roughness profile for illustrating a parameter Sm.

Referring to FIG. 5, the spacings between profile peaks on the mean line are s1, s2, s3 . . . , and $s_n$, respectively. Sm is represented by the following equation:

$$Sm = \frac{1}{n}\sum_{i=1}^{n} S_i = \frac{1}{n}(s1 + s2 + s3 + \ldots + s_n)$$

As can be seen from the definition of Sm as well as the above equation, the smaller Sm is, the closer and denser the peaks of the profile will be found on the surface, while the larger Sm is, the longer will be the distance of a relatively flat portion between the peaks of the profiles.

Figure 6:
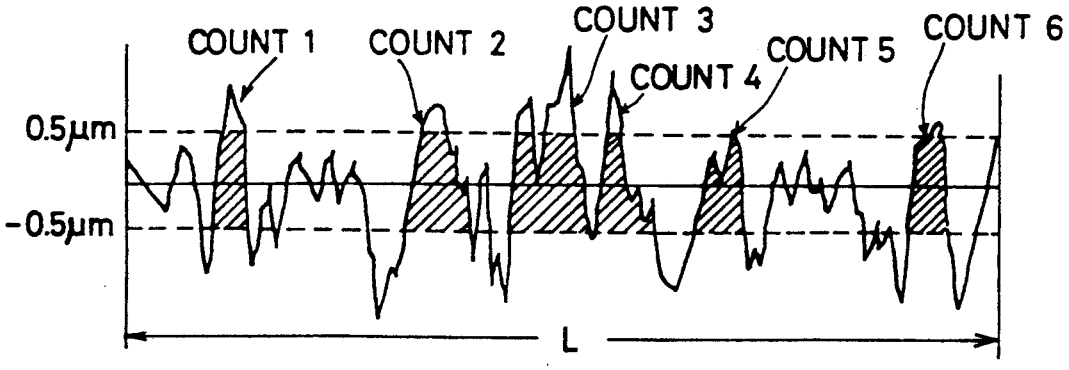
FIG. 6 is a diagram schematically showing a roughness profile for illustrating a parameter Pc.

As shown in FIG. 6, Pc indicates the number of all the local peaks which project through the band of a predetermined width centered about the mean line within the evaluation length L. The larger Pc is, the more peaks and valleys are formed on the surfaces with the larger height differences. In the following description, the width of the band is selected to be 1 μm.

A shadow mask plate in accordance with the present invention is characterized in that it has a surface deviation defined by the following parameter requirements. A process of manufacturing a shadow mask in accordance with the present invention is characterized by using the above-described shadow mask plate.

Ra in a shadow mask plate in accordance with the present invention falls within the range of 0.1 to 0.7 μm. Rsk is not more than 0.3. Rsk is preferably below 0. Sm not less than 60 μm. Pc is not more than 60/cm. A low carbon aluminum killed steel or an invar alloy having a thickness between approximately 0.1 and 0.3 mm is used for the shadow mask plate.

Among the above-described parameters, Ra defines conditions for successfully etching the shadow mask plate. The other parameters define conditions necessary for joining the shadow mask plates to each other by means of annealing.

A technique of producing a shadow mask plate having a surface deviation as described above is, for example, disclosed in Japanese Patent Laying-Open No. 64-56820, No. 55-76082, and Japanese Patent Publication No. 49-17909. In other words, a shadow mask plate having a desired surface deviation can be obtained by applying buffing, pickling, or shot blasting onto the surface of an aluminum killed steel or invar alloy material having a prescribed thickness. More generally, as shown in FIG. 7, dull rolls are used to process the surface of a shadow mask plate material 17.

Figure 7:
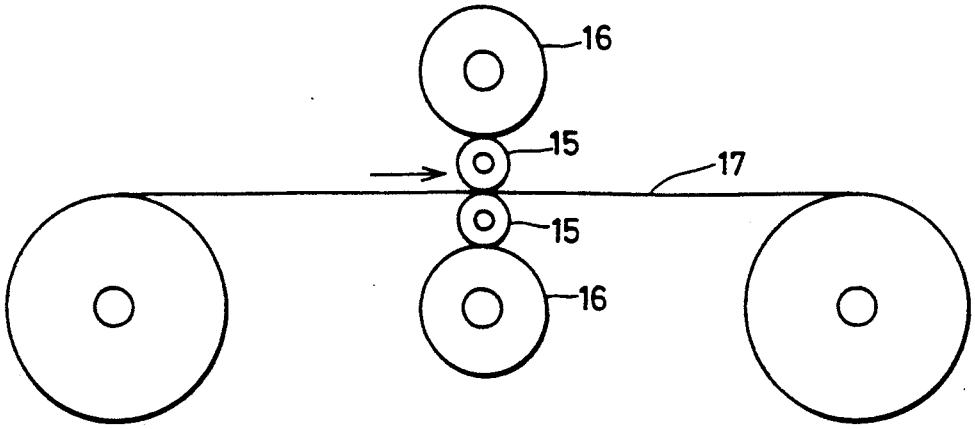
FIG. 7 is a schematic view showing a processing system using rolls for applying a prescribed surface deviation to a shadow mask plate.

Referring to FIG. 7, the shadow mask plate material 17 is passed through the nip of work rolls 15. The work rolls 15 are backed up by back up rolls 16, and pressure-contacted to each other. The outer peripheral surface of the work roll 15 is processed by shot blasting or by laser beam. A surface deviation defined by the foregoing parameters is created on the surface of the shadow mask plate material 17 to which the work rolls 15 are pressure-contacted. The shadow mask plate material 17 is cut out into a prescribed dimension, and a shadow mask plate is obtained.

A plurality of apertures are formed on each of the shadow mask plate in the following procedure.

Figure 8A:
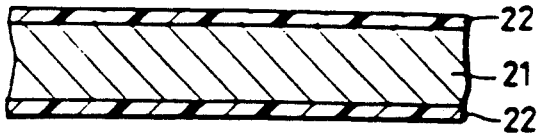
FIGS. 8A to 8E are schematic views showing a process of forming apertures on a shadow mask plate by means of etching.

Referring to FIG. 8A, a shadow mask plate 21 is degreased using alkaline water solution and washed in water. A photosensitive solution formed of milk casein and a water solution of ammonium bichromate is applied to both surfaces of shadow mask plate 21. The applied solution is heated and dried to form a photoresist film 22 having a thickness of several μm on the both sides of the shadow mask plate 21.

Figure 8B:
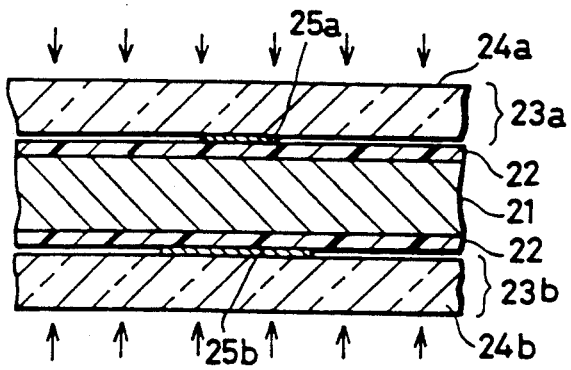

Referring to FIG. 8B, master patterns 23*a* and 23*b* are vacuum-contacted onto the surfaces of the resist films 22 on the both sides of the shadow mask plate 21, respectively. The master patterns 23*a* and 23*b* include glass plates 24*a* and 24*b*, respectively and aperture images 25*a* and 25*b* formed on the surfaces of the glass plates 24*a* and 24*b*, respectively. The master patterns 23*a* and 23*b* are registered so that the images 25*a* and 25*b* attain an appropriate positional relation. The master patterns 23*a* and 23*b* and the shadow mask plate 21 piled upon each other are exposed to light from a metal halide lamp. After the exposure, the master patterns 23*a* and 23*b* are removed from the shadow mask plate 21.

Figure 8C:
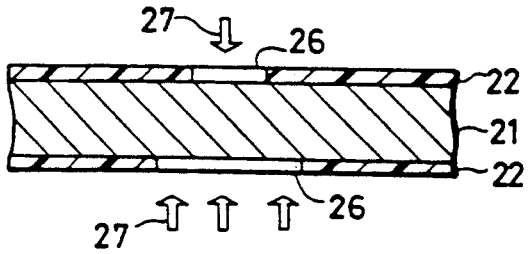

The shadow mask plate 21 and resist films 22 are dipped into a dilute chromate anhydride ($CrO_3$) solution, then washed in water, and furthermore, cured by burning. As a result, as shown in FIG. 8C, holes 26 are formed on the resist films 22 at portions corresponding to the aperture images. A ferric chloride aqueous solution 27 is sprayed onto the resist film 22.

Figure 8D:
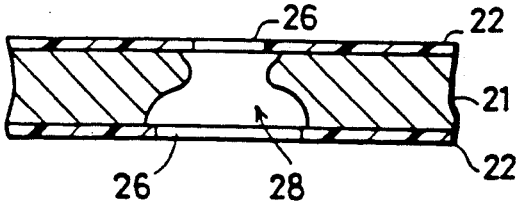
Figure 8E:
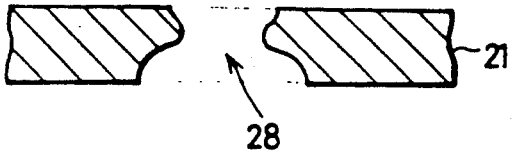

Referring to FIG. 8D, an exposed portion in the hole 26 in the surface of the shadow mask plate 21 is spray-etched by the ferric chloride aqueous solution. Consequently, an aperture 28 is formed in the shadow mask plate 21.

Referring to 8E, the resist films 22 are separated by an alkaline water solution. Thereafter, the shadow mask plate 21 is washed in water and dried, so that the shadow mask plate having an aperture 28 is produced.

Figure 9:
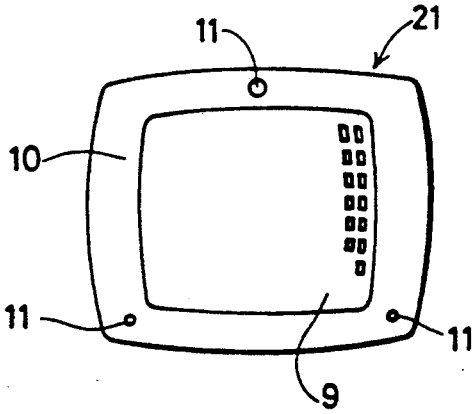
FIG. 9 is a plan view schematically showing a shadow mask plate.

At this time of etching, a plurality of registration holes 11 are formed in the shadow mask plate 21. An effective region 9 provided with a plurality of apertures is in the central area of the shadow mask plate 21 surrounded by a skirt 10. The registration holes 11 are formed in the skirt 10. In FIG. 9, three registration holes 11 are formed in one shadow mask plate 21.

Subsequently, a plurality of shadow mask plates which are registered and piled upon each other are subjected to annealing. Usually, two shadow mask plates are joined to each other to form one shadow mask.

Figure 10:
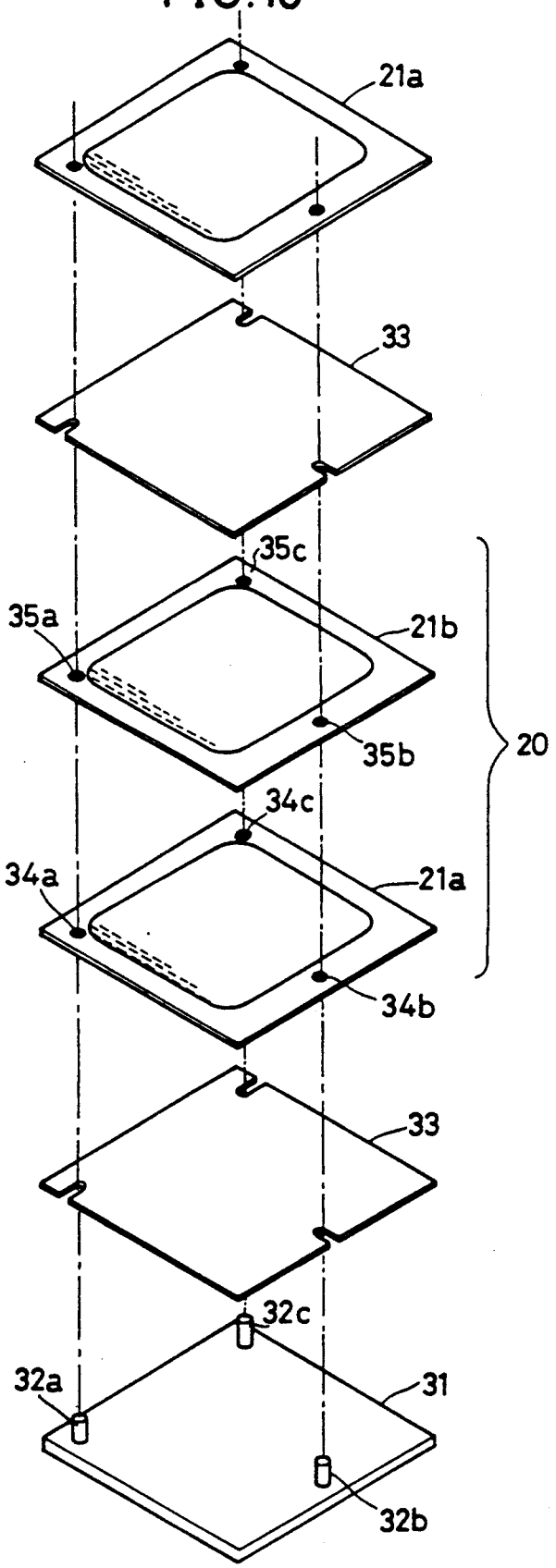
FIG. 10 is a schematic view showing the order of piling up shadow mask plates and spacers, when one shadow mask is formed by joining two shadow mask plates to each other.

A state of the registration of shadow mask plates for annealing is shown in FIG. 10. A base plate 31 with three registration pins 32*a* to 32*c* protruding thereon is prepared. A ceramic plate 33 is put on the base plate 31 as a spacer. Cutouts are provided at three places surrounding the ceramic plate 33. The cutouts are formed in positions corresponding to the registration pins 32*a* to 32*c*, respectively. The registration pins 32*a* to 32*c* are inserted into these cutouts, thereby registrating the ceramic plate 33 correctly on the base plate 31.

Two shadow mask plates 21*a* and 21*b* are stacked in this order on the ceramic plate 33. The shadow mask plate 21*a* has three registration holes 34*a* to 34*c*. The shadow mask plate 21*b* also has three registration holes 35*a* to 35*c*. The shadow mask plates 21*a* and 21*b* are registered so that the registration pins 32*a* to 32*c* are inserted into each of the registration holes 34*a* to 34*c* and 35*a* to 35*c*, respectively. Such registration permits the apertures formed in the shadow mask plates 21*a* and 21*b* to be registered to each other.

Another ceramic plate 33 is stacked on the shadow mask plate 21*b*. The registration of the ceramic plate 33 is also performed using the registration pins 32*a* to 32*c* of the base plate 31.

A prescribed number of sets of shadow mask plates 21*a* and 21*b* are further piled upon the ceramic plate 33. The ceramic plate 33 is interposed as a spacer between pairs of the shadow mask plates.

As has been described by referring to FIG. 10, the shadow mask plates 21*a* and 21*b* are, as piled upon each other, subjected to annealing. Conditions for annealing is required as follows depending upon the material used for the shadow mask plates 21*a* and 21*b*.

The shadow mask plates 21*a* and 21*b* formed of aluminum killed steel are annealed in a gas atmosphere containing 90% nitrogen ($N_2$) and 10% hydrogen ($H_2$), with a due point between 0° and 10° C., at a temperature of 830° C. for ten minutes. The shadow mask plates 21*a* and 21*b* formed of an invar alloy are annealed under a high vacuum pressure (for example $10^{-1}$ Torr) at a temperature of 1000° C. for ten minutes.

The annealing performed under the above-described conditions, the shadow mask plates 21 and 21*b* are completely joined to each other, constituting one shadow mask 20.

The ceramic plate 33 serves as a means of isolating shadow masks formed by this annealing from each other. The ceramic plate 33 is preferably of $Al_2O_3$. Crystallized glass or stainless steel may be used for the spacer.

Now a comparison will be made between the effects obtained when a shadow mask is manufactured by a conventional process and the effects brought about when a shadow mask is manufactured in accordance with the manufacturing process of the present invention.

TABLE 1

| | SAMPLES | KIND OF PLATE MATERIAL | Ra (μm) | Rsk | Sm (μm) | Pc | RESULT OF ANNEALING |
|---|---|---|---|---|---|---|---|
| PREFERRED | a | ALUMINUM | 0.47 | −0.9 | 73 | 44 | ○ |
| EMBODIMENT | b | KILLED | 0.52 | −0.6 | 63 | 52 | ○ |
| | c | STEEL | 0.61 | −0.5 | 90 | 43 | ○ |
| | d | INVAR | 0.40 | 0.1 | 63 | 33 | ○ |
| | e | ALLOY | 0.44 | 0.3 | 89 | 37 | ○ |
| FOR | f | ALUMINUM | 0.65 | 0.1 | 75 | 65 | Δ |

TABLE 1-continued

| | SAMPLES | KIND OF PLATE MATERIAL | Ra (μm) | Rsk | Sm (μm) | Pc | RESULT OF ANNEALING |
|---|---|---|---|---|---|---|---|
| COMPARISON | g | KILLED | 0.59 | −0.5 | 71 | 68 | Δ |
| | h | STEEL | 0.58 | 0.6 | 50 | 87 | × |
| | i | | 0.56 | 0.5 | 51 | 93 | × |
| | j | | 0.37 | 0.7 | 40 | 74 | × |
| | k | INVAR | 0.41 | 0.1 | 58 | 43 | × |
| | l | ALLOY | 0.43 | 0.5 | 60 | 44 | × |

<<RESULT OF ANNEALING>>
○: NO MISRREGISTRATION
Δ: MALREPRODUCTIBILITY (WITH PARTIAL MISREGISTRATION)
×: MISREGISTRATION OCCURRED

Referring to Table 1, in the experiment, shadow mask plates a to e formed of aluminum killed steel or an invar alloy having surface roughness as shown in Table 1 were used. The shadow mask plates a to e had surface deviations in accordance with the present invention. A method principally set forth in FIG. 7 was used to process the surfaces of the shadow mask plates to obtain a desired surface deviation. In other words a desired surface deviation was obtained on the material 17 by passing the same between the nip of a pair of work rolls 15 having their outer peripheral surfaces processed by shot blasting. Thus, formed surface deviation was measured using a Forum Talysurf S4C manufactured by RANK TAYLOR HOBSON Inc.

A plurality of apertures were formed in the shadow mask plate cut out from the material 17 by a general etching process as has been already described. Twenty shadow mask plates were prepared for each kind a to e (Table 1) of the shadow mask plate. Apertures were formed in a preferable manner on each of the shadow mask plates.

Shadow mask plates of the same kinds were registered and piled upon each other by two in accordance with a manner shown in FIG. 10. A stainless steel (SUS304) plate having a thickness of 0.3 mm was used for a spacer in place of the ceramic plate 33. One lot included twenty shadow mask plates piled upon each other in total. In other words, one lot included ten pairs of shadow mask plates. One lot of shadow mask plates were annealed under conditions as described above.

As a result of this annealing process, each pair of the shadow masks were completely joined to each other in the case of shadow mask plates a to e. Also in the subsequent press molding process, no misregistration was appreciated between two shadow mask plates.

For the purpose of comparison, a shadow mask was manufactured in accordance with the same process as the above-described manufacturing process, using shadow mask plates f to l in Table 1. Etching of all the shadow mask plates was successfully carried out. Inspection revealed that misregistration between two shadow mask plates constituting the shadow mask after press-molding was different from the case in which the shadow mask plates a to e were used.

More specifically, at part of the shadow mask manufactured using the shadow mask plates f and g, misregistration was made between these two shadow mask plates at the time of press molding. Furthermore, misregistration was found between the shadow mask plates at the time of press molding in all of the shadow masks formed using the shadow mask plates h to l. It is believed that this misregistration came about because the adherence of the two shadow mask plates to each other was not sufficiently firm.

Figure 11:
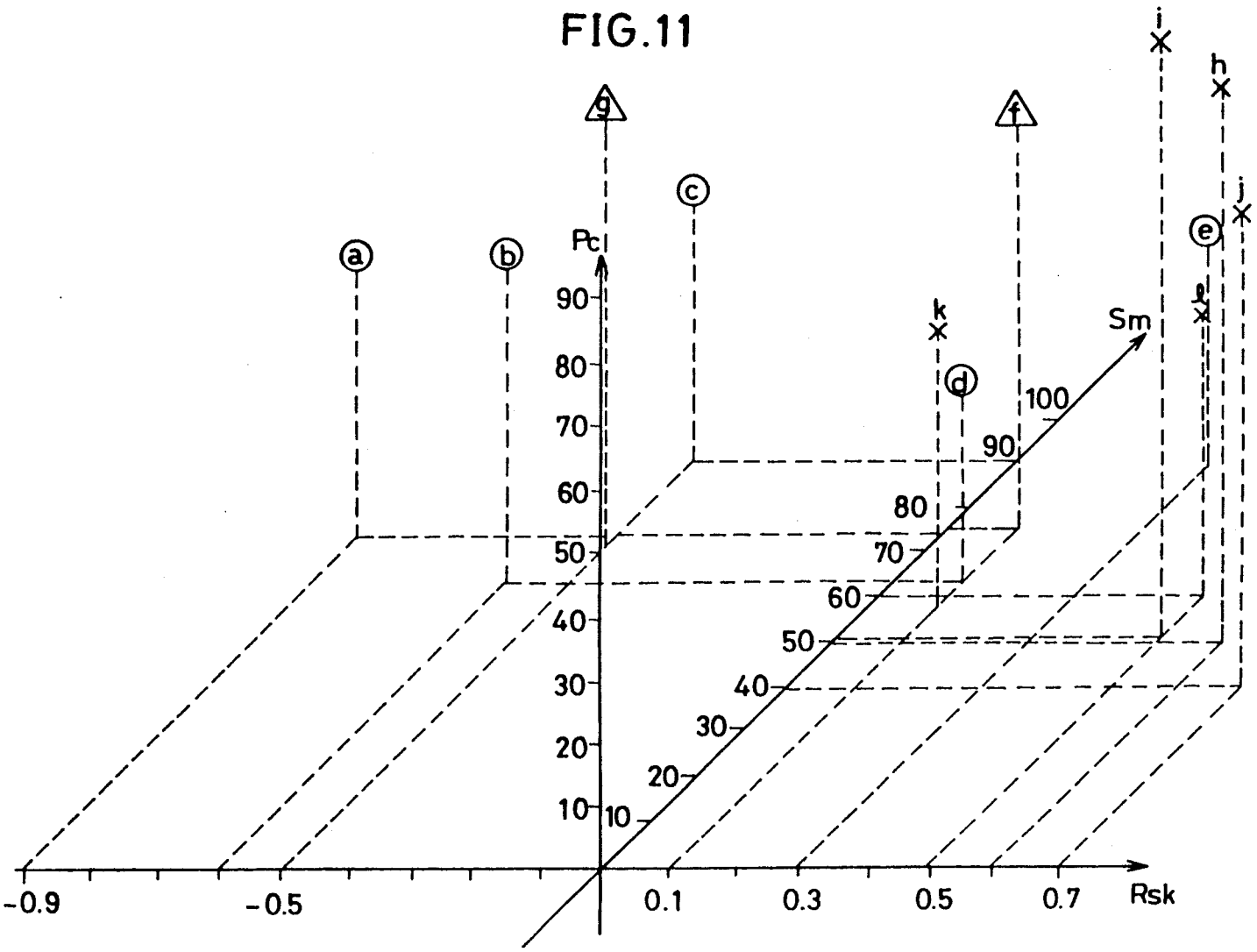
FIG. 11 is a representation schematically showing the result of a manufacturing process in accordance with the present invention.

FIG. 11 is a schematic three-dimensional representation showing the result of the experiment set forth in Table 1. Referring to Table 1 and FIG. 11, the shadow mask plates can be joined to each other by annealing, if the shadow mask plates have a surface deviation in which Rsk is not more than 0.3 μm, Sm is not less than 60 μm, and Pc is not more than 60 μm. Thus, a formed shadow mask has a sufficient strength against deformation at the time of press molding. Furthermore, sufficient strength for restraining the occurrence of doming can be obtained. Additionally, etching may just be applied to even a thin shadow mask plate, and, therefor, the etching can be performed successfully even when the spacing of apertures decreases. In addition, the shadow mask plates are joined simultaneously in the process of annealing. Therefore, it is not necessary to apply any special processing for joining these plates to each other. Time required for joining is also saved accordingly.

The reason for the above-described effects brought about by the shadow mask plate having parameters each of which falls within the above-mentioned ranges is considered to be as follows. As has been described by referring to FIG. 4, if Rsk is small, the area in the vicinity of the summit of the peak on the roughness profile is flatter. The area of the shadow mask plates in contact with each other becomes large, and the shadow mask plates piled upon each other are easily joined to each other by means of annealing. As can be seen from the experiment, a good result is obtained if Rsk is not more than 0.3. If Rsk is preferably below 0, the peak of the roughness profile gets gentle as described above, and, therefore, the shadow mask plates are joined to each other by annealing even more firmly.

Sm is selected to be not less than 60 μm. A relatively flat distance between the peaks of the roughness profile of the surfaces of the shadow mask plates is sufficiently long, and the surfaces of the shadow mask plates are liable to come in contact to each other. It is considered that the adherence of the shadow mask plates to each other gets even more firmly as a result.

Pc is set to be not more than 60/cm. If Pc is large, a relatively large space is created between the shadow mask plates, thereby hampering the adherence of the shadow mask plates to each other. However, setting Pc in the range not more than 60/cm permits the space between the shadow mask plates to be reduced, thereby facilitating the adherence of the shadow mask plates to each other.

On the other hand, what is represented by the parameter Ra is different from the other three parameters Rsk, Sm and Pc. Ra defines conditions for etching the shadow mask plates successfully. Suppose that Ra is set to be less than 0.1 μm. In this case, it is well known that resist will not easily adhere onto the surface of the shadow mask plate. It is also well known that it takes an unduly long time period to make a master pattern come closely into contact with a resist film and to draw air therefrom. Now, assume that Ra is more than 0.7 μm. In this case, it is well known that the linearity of the edge of an aperture formed in a shadow mask plate is degraded by etching. Consequently, the amount of electron beams passing through the apertures is uneven over the manufactured shadow mask. It is well known that this is responsible for degradation in the quality of the shadow mask.

A shadow mask plate material in accordance with the present invention has Ra in the range between 0.1 and 0.7 μm. The material is therefore free from the above-described problems.

Figure 12:
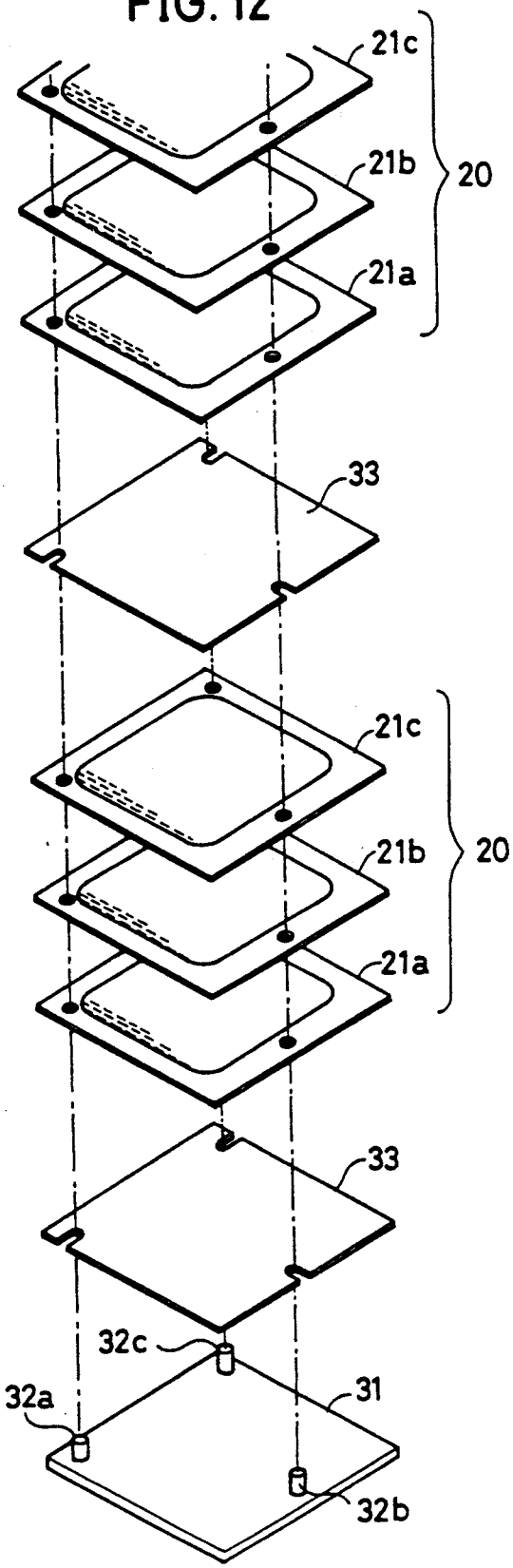
FIG. 12 is a schematic view showing the order of shadow mask plates and spacers in a process of manufacturing one shadow mask by joining three shadow mask plates.

In the above-described embodiments, as shown in FIG. 10, one shadow mask 20 is obtained by joining two shadow mask plates 21*a* and 21*b* to each other. But the present invention is not limited thereto. For example, as shown in FIG. 12, the shadow mask 20 may be formed by joining three shadow mask plates 21*a*, 21*b* and 21*c*. All the shadow mask plates are joined by annealing at the same time. Therefore, it is not necessary to increase manufacturing steps for joining shadow mask plates if the number of shadow mask plates to be joined is increased.

As can be easily expected, the present invention is readily applicable to the case in which more than 4 shadow masks plates are joined to each other.

Figure 13:
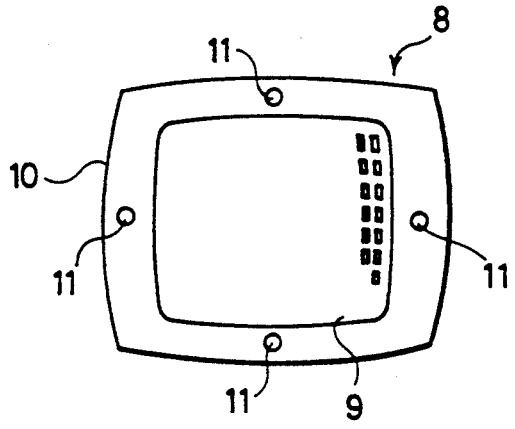
FIG. 13 is a plan view schematically showing a shadow mask plate.

In the above-described embodiment, three registration holes are formed in the shadow mask plate. But the present invention is not limited thereto. For example, as shown in FIG. 13, four registration holes 11 may be formed in the skirt 10 of the shadow mask plate 21. The registration is successfully achieved if the number of registration holes to be formed in one shadow mask plate is more than two.

Further, the present invention is not limited to the above embodiments wherein each of the shadow mask plates has a plurality of registration holes and wherein the shadow mask plates are registered by using the registration holes during the annealing process.

Figure 14:
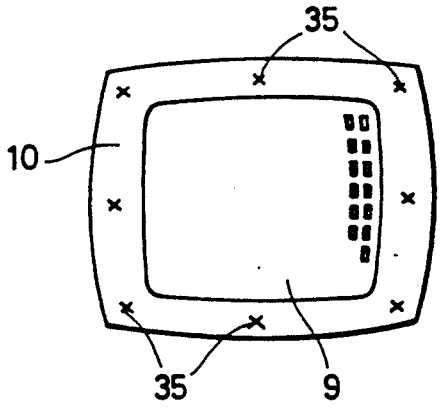
FIG. 14 is a plan view schematically showing a shadow mask plate.

For example, referring to FIG. 14, the shadow mask plates may be spot welded at some points 35 of the skirts 10 in the first place. Subsequently, the shadow mask plates are subjected to annealing and joined to each other. Since it does not take a long time for the shadow mask plates to be spot welded at several points 35 of the skirts 10 only, that will be no problem to the achievement of the objective aforementioned. Needless to say, registration by inserting the registration pins 32*a* through 32*c* into the registration holes 34*a* through 34*c* and 35*a* through 35*c* may be conducted during the above spot-welding process.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A process of manufacturing a shadow mask suitable for use in a cathode ray tube, comprising the steps of:

preparing a plurality of metal plates;

forming a plurality of apertures in said metal plates for passing electron beams therethrough;

piling up said plurality of metal plates in close contact in such a manner that said apertures formed in each of said metal plates are arranged in a predetermined positional relation;

annealing said piled up metal plates; and pressing and molding said piled and annealed metal plates into a predetermined curvature, wherein said metal plates are joined to each other in said annealing step due to surface deviation thereof, and remain joined to each other after said passing and molding step as well as after said shadow mask is assembled as an element of a cathode ray tube.

2. A process of manufacturing a shadow mask suitable for use in a cathode ray tube, comprising the steps of:

preparing a plurality of metal plates;

forming a plurality of apertures in said metal plates for passing electron beams therethrough;

piling up said plurality of metal plates in close contact in such a manner that said apertures formed in each of said metal plates are arranged in a predetermined positional relation;

annealing said piled up metal plates;

pressing and molding said piled and annealed metal plates into a predetermined curvature, wherein said metal plates are joined to each other in said annealing step due to surface deviation; and each of said metal plates having a surface deviation characterized in that an Rsk value is not more than 0.3 μm, an Sm value is not less than 60 μm, and a PC value relative to the band of 1 μm width centered about the center line of the roughness profile is not more than 60/cm.

3. The process of manufacturing a shadow mask in accordance with claim 2, wherein the Rsk value of the surface deviation of said metal plate is negative.

4. The process of manufacturing a shadow mask in accordance with claim 2, wherein the material of said metal plate is selected from the group consisting of low carbon aluminum killed steel and an invar alloy.

5. The process of manufacturing a shadow mask in accordance with claim 2, wherein the thickness of said metal plate is in the range of 0.1 mm and 0.3 mm.

6. The process of manufacturing a shadow mask in accordance with claim 2, wherein the Ra value of said metal plate is in the range of 0.1 μm and 0.7 μm, and said aperture formation step includes the steps of;

forming a resist layer having an opening in said metal plate for defining said aperture, and etching said metal plate on the surface of which said resist layer is formed.

7. The process of manufacturing a shadow mask in accordance with claim 6, wherein said resist layer formation step includes forming said resist layers on both surfaces of said metal plate.

8. The process of manufacturing the shadow mask in accordance with claim 7, wherein said etching step includes supplying an etching agent onto said both surfaces of said metal plate on which said resist layers are formed.

9. The process of manufacturing a shadow mask in accordance with claim 2, wherein said preparation step includes the steps of;

preparing dull rolls provided with a predetermined processing on the outer peripheral surfaces thereof, and applying said surface deviation by pressing the surfaces of said metal plate by said dull rolls.

10. The process of manufacturing a shadow mask in accordance with claim 2, wherein said preparation step includes performing buffing onto the surface of a metal plate having a predetermined thickness.

11. The process of manufacturing a shadow mask in accordance with claim 2, wherein said preparation step includes pickling the surface of a metal plate having a predetermined thickness.

12. The process of manufacturing a shadow mask in accordance with claim 2, wherein said preparation step includes providing the surface of the metal plate having a predetermined thickness with shot blasting processing.

13. The process of manufacturing a shadow mask in accordance with claim 2, further comprising the step of forming a plurality of through-holes for registrating each of said metal plates into a predetermined position, wherein said piling up step includes the steps of preparing metal plate supporting means having an upper surface for supporting the surface of said metal plate and a plurality of pins disposed upright in a positional relation identical to the positional relation between the plurality of through-holes formed in said metal plate; and piling up a predetermined number of said metal plates upon each other on said metal plate supporting means for forming one said shadow mask in such a manner that each of said pins is inserted in said through-hole.

14. The process of manufacturing a shadow mask in accordance with claim 13, wherein said piling up step further includes the steps of:

stacking a spacer formed of a predetermined material different from said metal plate on said metal plate installed on said metal plate supporting means, and piling up a predetermined plural number of said metal plates upon each other for forming a further said shadow mask on said spacer.

15. The process of manufacturing a shadow mask in accordance with claim 14, wherein each said metal plate has effective and non-effective portions, and prior to said annealing step said metal plates are spot welded at predetermined points of said non-effective portions.

16. The process of manufacturing a shadow mask in accordance with claim 14, wherein said spacer includes SUS stainless steel.

17. The process of manufacturing a shadow mask in accordance with claim 16, wherein said spacer includes SUS stainless steel having a plurality of depressions on each surface.

18. The process of manufacturing a shadow mask in accordance with claim 14, wherein said spacer includes ceramic.

19. The process of manufacturing a shadow mask in accordance with claim 18, wherein said ceramic includes $Al_2O_3$.

20. The process of manufacturing a shadow mask in accordance with claim 14, wherein said spacer includes glass.

21. The process of manufacturing a shadow mask in accordance with claim 20, wherein said glass includes crystallized glass.

22. The process of manufacturing a shadow mask in accordance with claim 14, wherein more than three metal plates are necessary for forming said one shadow mask.

23. The shadow mask manufactured by the process in accordance with claim 1.

24. The shadow mask manufactured by the process in accordance with claim 2.

25. The shadow mask manufactured by the process in accordance with claim 3.

26. The shadow mask manufactured by the process in accordance with claim 4.

27. The shadow mask manufactured by the process in accordance with claim 5.

28. The shadow mask manufactured by the process in accordance with claim 6.

29. The shadow mask manufactured by the process in accordance with claim 7.

30. The shadow mask manufactured by the process in accordance with claim 8.

31. The shadow mask manufactured by the process in accordance with claim 9.

32. The shadow mask manufactured by the process in accordance with claim 10.

33. The shadow mask manufactured by the process in accordance with claim 11.

34. The shadow mask manufactured by the process in accordance with claim 12.

35. The shadow mask manufactured by the process in accordance with claim 13.

36. The shadow mask manufactured by the process in accordance with claim 14.

37. The shadow mask manufactured by the process in accordance with claim 15.

38. The shadow mask manufactured by the process in accordance with claim 16.

39. The shadow mask manufactured by the process in accordance with claim 17.

40. The shadow mask manufactured by the process in accordance with claim 18.

41. The shadow mask manufactured by the process in accordance with claim 19.

42. The shadow mask manufactured by the process in accordance with claim 20.

43. The shadow mask manufactured by the process in accordance with claim 21.

44. The shadow mask manufactured by the process in accordance with claim 22.

45. A shadow mask plate for manufacturing a shadow mask suitable for use in a cathode ray tube, comprising a metal plate having a surface deviation characterized in that its Ra value is in the range of 0.1 μm and 0.7 μm, its Rsk value is not more than 0.3 μm, its Sm value is not less than 60 μm, and its Pc value relative to the band of 1 μm width centered about the central line is not more than 60/cm.

46. The shadow mask plate for manufacturing a shadow mask in accordance with claim 45, wherein the Rsk value of the surface deviation of said metal plate is negative.

47. The shadow mask plate for manufacturing a shadow mask in accordance with claim 45, wherein the material of said metal plate is selected from the groups consisting of low carbon aluminum killed steel and an invar alloy.

48. The shadow mask plate for manufacturing a shadow mask in accordance with claim 45, wherein the thickness of said metal plate is in the range of 0.1 mm and 0.3 mm.

49. A process of manufacturing a shadow mask suitable for use in a cathode ray tube, comprising the steps of:

preparing a plurality of metal plates each having effective and non-effective portions;

forming a plurality of apertures in said metal plates for passing electron beams therethrough;

piling up said plurality of metal plates in close contact in such a manner that said apertures formed in each of said metal plates are arranged in a predetermined positional relation;

spot welding said metal plates at predetermined points of said non-effective portions;

annealing said piled up metal plates to join said metal plates to each other at their said effective portions; and pressing and molding said piled and annealed metal plates into a predetermined curvature while said metal plates remained joined to each other at their said effective portions.

50. The process of manufacturing a shadow mask in accordance with claim 49, wherein said piling up step further includes the step of:

stacking a predetermined supporting means to support said metal plates while said annealing step is being carried out;

prior to said annealing step, piling up groups comprising a predetermined plural number of said metal plates upon each other for forming further ones of said shadow masks on said spacer means, and prior to said annealing step, stacking spacer means so that they are disposed between adjacent ones of said groups of said plates, with said spacer means being formed of a predetermined material different from that of said metal plates, and selected so that the annealing step does not cause joining of said spacer means to said metal plates.

51. A process of manufacturing a shadow mask in accordance with claim 49, wherein each of said metal plates has a surface deviation characterized in by an Rsk value that is not more than 0.3 μm, an Sm value is not less than 60 μm, and a Pc value relative to the band of approximately 1 μm width that centered abut the center line of the roughness profile that is not more than 60/cm, and said metal plates being joined to each other in said annealing step due to surface deviation.

52. The process of manufacturing a shadow mask in accordance with claim 51, wherein said piling up step further includes the steps of:

stacking a spacer formed of a predetermined material different from said metal plate on said metal plates installed on predetermined metal plate supporting means, and piling up a predetermined plural number of said metal plates upon each other for forming a further ones of said shadow mask on said spacer.

53. A process of manufacturing a shadow mask suitable for use in a cathode ray tube, comprising the steps of:

preparing a plurality of metal plates;

forming a plurality of apertures in said metal plates for passing electron beams therethrough;

forming a plurality of through-holes for registering each of said metal plates into a predetermined position, piling up said plurality of metal plates in close contact in such a manner that said apertures formed in each of said metal plates are arranged in a predetermined positional relation;

annealing said piled up metal plates;

pressing and molding said piled and annealed metal plates into a predetermined curvature;

said piling up step including the steps of preparing metal plate supporting means having an upper surface for supporting said metal plates and a plurality of pins disposed upright in a positional relation identical to the positional relation between the plurality of through-holes formed in said metal plate; and piling up a predetermined number of said metal plates upon each other on said metal plate supporting means in such a manner that each of said pins is inserted in said through-hole; wherein said metal plates are joined to each other during said annealing step and remain joined after said pressing and molding step as well as after said shadow mask is assembled as an element of a cathode ray tube.

54. The process of manufacturing a shadow mask in accordance with claim 53, wherein said piling up step further includes the steps of:

stacking a predetermined supporting means to support said metal plates while said annealing step is being carried out;

prior to said annealing step, piling up groups comprising a predetermined plural number of said metal plates upon each other for forming further ones of said shadow masks on said spacer means, and prior to said annealing step, stacking spacer means so that they are disposed between adjacent ones of said groups of said plates, with said spacer means being formed of a predetermined material different from that of said metal plates, and selected so that said annealing step does not cause joining of said spacer means to said metal plates.

* * * * *